US005234168A

United States Patent [19]

Abboud

[11] Patent Number: 5,234,168

[45] Date of Patent: Aug. 10, 1993

[54] LIQUID ATOMIZING SPRAY NOZZLE

[76] Inventor: Harry I. Abboud, 5845 Clematis Dr., Baton Rouge, La. 70808

[21] Appl. No.: 750,496

[22] Filed: Aug. 27, 1991

[51] Int. Cl.[5] ..... B05B 7/06

[52] U.S. Cl. ..... 239/424; 239/520

[58] Field of Search ..... 239/420–424, 239/424.5, 518, 520, 416.4, 416.5

[56] References Cited

U.S. PATENT DOCUMENTS

| | | | |
|---|---|---|---|
| 1,075,742 | 10/1913 | Weintz | 239/424 X |
| 1,242,567 | 10/1917 | Limbacher | 239/424 |
| 2,089,673 | 8/1937 | Steinmann | 239/518 X |
| 3,050,262 | 8/1962 | Curtis | 239/424 X |
| 4,284,242 | 8/1981 | Randell | 239/423 X |

*Primary Examiner*—Andres Kashnikow
*Assistant Examiner*—Kevin Weldon
*Attorney, Agent, or Firm*—Llewellyn A. Proctor

[57] ABSTRACT

A liquid atomizing spray nozzle for admixing a liquid hydrocarbon fuel with oxygen (air) and burning the mixture to supply heat. The burner body portion of the device is constituted of a pair of concentric tubes, each provided with an inlet and annular outlet for the fuel and oxygen, respectively. A deflector of conic shape is axially mounted within the inside tube, the sloped side of which is faced inwardly toward the annular outlets and in a straight line therewith so that both of the concentric tubular columns forming the streams emitted from the annular outlets of the concentric tubes impact on the sloped surface near the apex of the cone to admix one stream with the other, and are forced outwardly to form a combustible mixture which, on ignition, burns ex situ of the burner body. The deflector is extended outwardly from the burner body at a critical distance ranging from about 0.5 to about 5 times the diameter of the annular outlet through which the oxygen is ejected.

14 Claims, 3 Drawing Sheets

LIQUID ATOMIZING SPRAY NOZZLE

FIELD OF THE INVENTION

This invention relates to improvements in liquid atomizing spray nozzles, inclusive of burners, or spray driers, wherein e.g., the liquid portion of a salt solution is atomized and the liquid separated from the salt, or wherein a liquid hydrocarbon fuel is atomized and burned in oxygen, air or other oxygen-containing gas, to supply heat. In particular, it relates to a novel nozzle useful for admixing a liquid hydrocarbon fuel, or fuel oil, with air, and burning same to produce heat.

BACKGROUND

Spray driers as a class are well known. Likewise, burners are widely known for commercial and industrial use in mixing a liquid hydrocarbon fuel with oxygen, air or other oxygen-containing gas; and they are of numerous types and designs. In one type, the fuel is admixed internally with air within the fuel oil burner, the fuel oil often being brought into the burner as a whirling vortex to which air is supplied prior to injection from a nozzle, and ignition. A major deficiency of this type of burner is that the flame burns the combustible mixture at the forward, or ejection end of the burner to produce copious amounts of carbon, or coke. This, of course, not only reduces the thermal efficiency of the burner, but all too soon fouls the burner. Shut down to clean the burner, of course, can produce further losses in process efficiency.

In a burner described by reference to U.S. Pat. No. 1,563,246 oil is supplied to an oil supply tube terminating in an annular oil discharge opening in which is mounted a cone-shaped deflector. The oil supply tube terminates within a mixing chamber secured to an air supply nozzle adapted to direct a stream of air against the outer end of the oil supply tube and deflector to atomize the oil and mix the atomized oil and air within the mixing chamber. In this device the combustible mixture is burned within the mixing chamber to produce copious amounts of carbon, and form coke.

OBJECTS

It is, accordingly, the object of this invention to provide a device, or spray nozzle for the multi stage atomization of a liquid, and ejection of the liquid mist in a controlled pattern; particularly a device for the atomization of a liquid in a stream of gas, and ejection of the liquid-gas spray in a controlled pattern.

A further object is to provide a novel burner, or burner nozzle, wherein a liquid hydrocarbon fuel and oxygen, or air or other oxygen-containing gas, supplied to the burner are atomized, ejected and burned ex situ of the burner.

THE INVENTION

These objects and others are achieved in accordance with the present invention which, in all embodiments, includes a device for the atomization of a liquid, particularly the atomization of liquid and gas dispersed therewith, characterized as a nozzle, constituted of members forming concentric chambers to which a liquid e.g., a hydrocarbon fuel, and a gas, e.g., oxygen or an oxygen-containing gas, respectively, are admitted and jetted outwardly against a deflector of conic-shape mounted on the distal end of a shaft supported by the nozzle, are admixed, or admixed and ignited, ex situ of the nozzle, to avoid solids or coke formation, and deposition thereof within the nozzle.

In its preferred aspects, coaxially mounted tubes of the nozzle, or burner, are formed of component parts. The small diameter pipe forming the inner chamber is constituted of a pipe, a shaft guide within which a shaft carrying the deflector is mounted, and suitably a union which connects these members together, preferably by threadable engagement one member with the other. The large diameter pipe, or pipe surrounding the small diameter pipe, is preferably formed of component parts, suitably a large diameter pipe per se adjoined to another pipe of intermediate diameter. The side wall of the latter is perforated so that the annular chambers formed by enclosing the small diameter pipe are communicated one with the other. The forward and rearward walls of the large diameter pipe is closed by end walls, leaving an inlet and outlet for the introduction and removal of the gaseous stream. The same is generally true of the small diameter pipe assembly. An inlet and outlet is provided for the introduction and removal of the liquid stream. The outlets in both tubes provide for the injection of separate, coaxially flowing streams which are admixed one with the other only on impact with the sloped side of the deflector. The apparatus is thus comprised of coaxially mounted tubes, (i) a tube of small diameter formed by an enclosing side wall, providing an inner chamber to which a stream of liquid, e.g., a liquid hydrocarbon fuel, can be admitted via an inlet, and ejected via an outlet, and (ii) and a tube of large diameter formed by an enclosing wall of diameter sufficient to form an annular passageway to which a stream of gas, e.g., oxygen, air or other oxygen-containing gas, can be admitted via an inlet, and ejected via an outlet, for contact with the sloped side of a deflector of conic shape such that on impact therewith the two streams will be forced outwardly to admix one stream with the other, e.g., to form a combustible mixture which, on ignition, will burn ex situ of the nozzle, or burner.

This invention, and its principle of operation, will be more fully understood by reference to the following detailed description of a specific and preferred device, or nozzle, and to the attached drawing to which reference is made in the description. Similar numbers are used in the different views, or figures, to represent corresponding elements. Where a subscript is used with a number, the subscript indicates that the element, or component, referred to is present in the assembly as a plurality of similar elements, or components. Where reference is made in the description to a number without regard to subscripts, the reference is intended in a generic sense.

Figures 3, 3A:
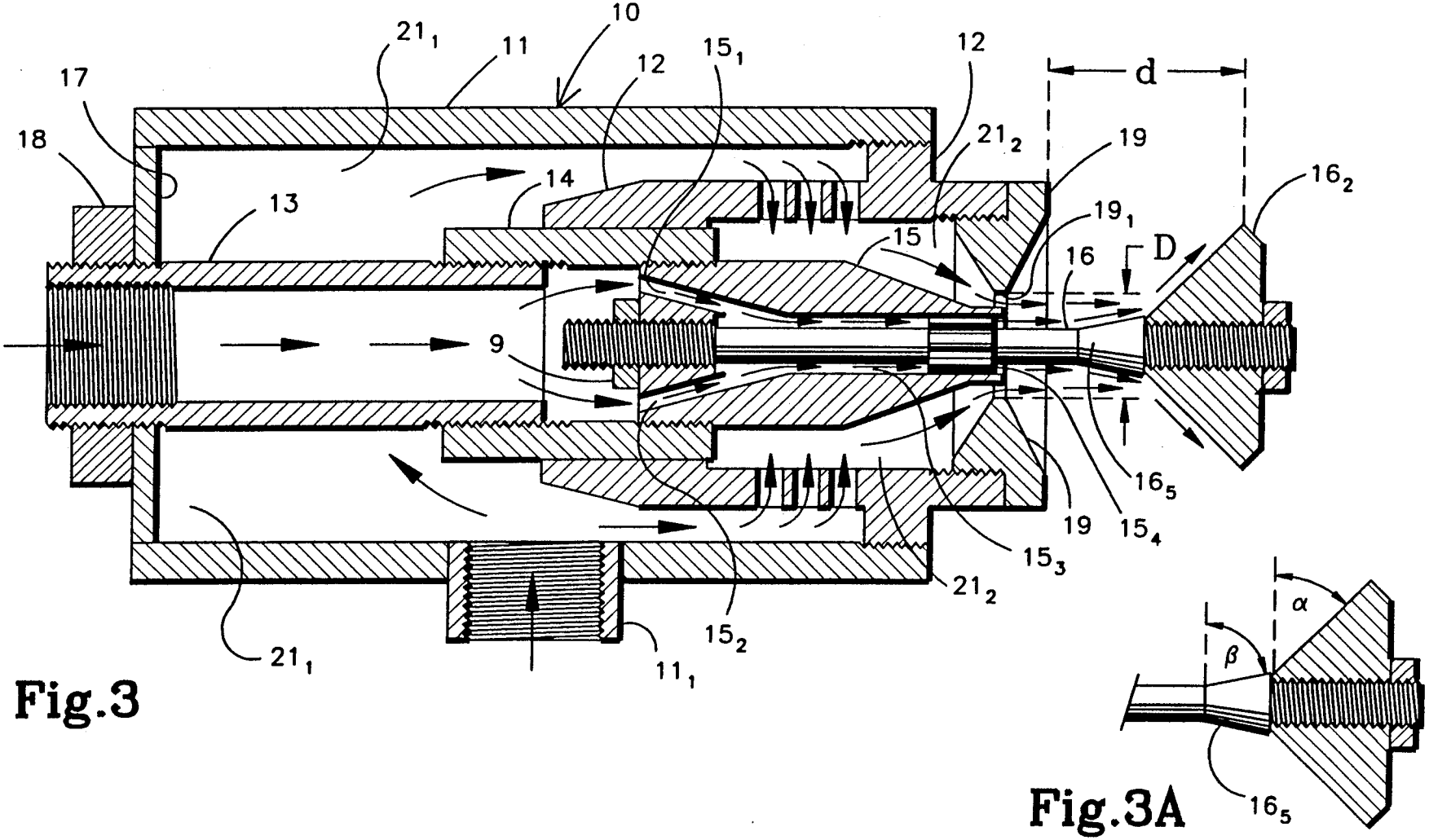

FIG. 3 again depicts the device in assembled form, but with arrows imposed thereon to represent the flow paths of the fluids as occurs in operation of the nozzle; and FIG. 3A depicts certain details in the structure of one of the components parts of the nozzle.

Figure 1:
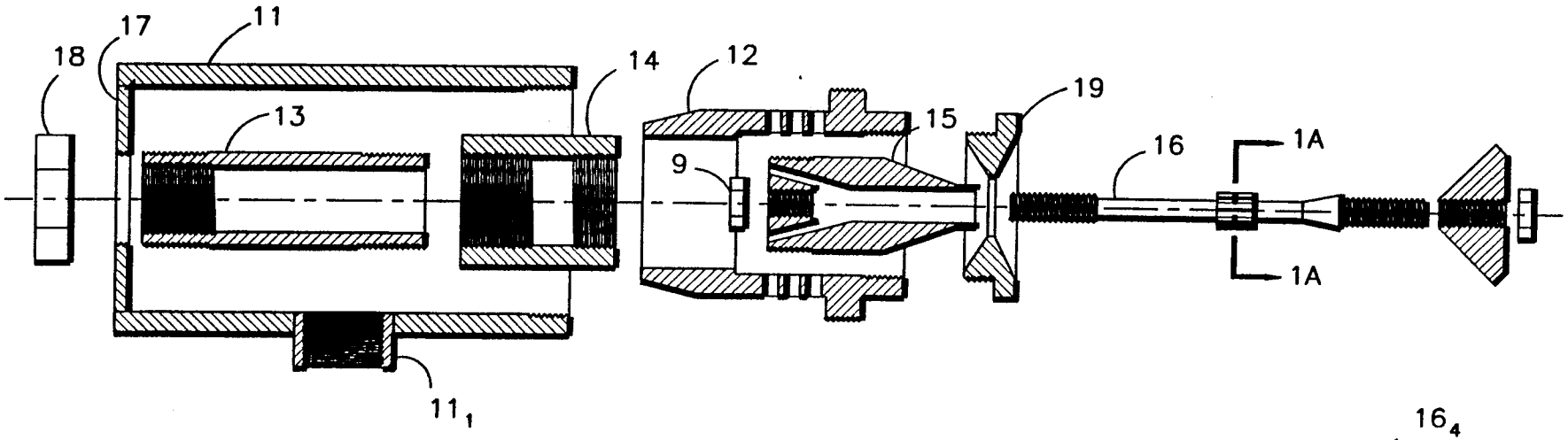
FIG. 1 depicts in cross-section the disassembled nozzle, or nozzle in exploded form, for ease of identification of the component parts of the device.
Figure 1A:
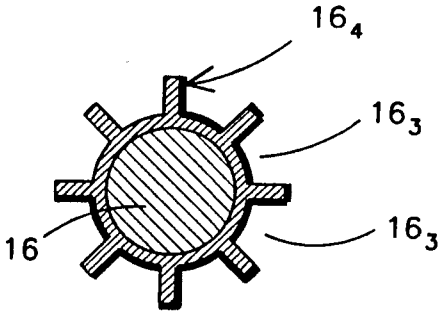
FIG. 1A depicts certain details of one of the component parts of the nozzle.

Referring first to FIG. 1, the nozzle 10 is constituted generally of (1) a large diameter outer tubular member, or pipe 11, which can be assembled with a tubular member 12 of intermediate diameter, and (2) an inner tubular assembly which includes a small diameter inner tubular member, or pipe 13, and shaft guide 15 which can be joined together via union 14, and a shaft assembly 16 for mounting within the shaft guide 15. The rearward end of shaft assembly 16 can thus be threadably engaged and connected to the rearward end of the shaft guide 15 to form a unit, this unit can then be threadably connected via the rearward end of shaft guide 15 to the forward end of the union 14, this assembly then threadably adjoined via union 14 to small diameter pipe 13, and small diameter pipe 13 threadably adjoined to the enclosing wall 17 in pipe 11. (3) With tubular member 12 and ring partition member 19 in place, the nozzle is then assembled.

Figure 2:
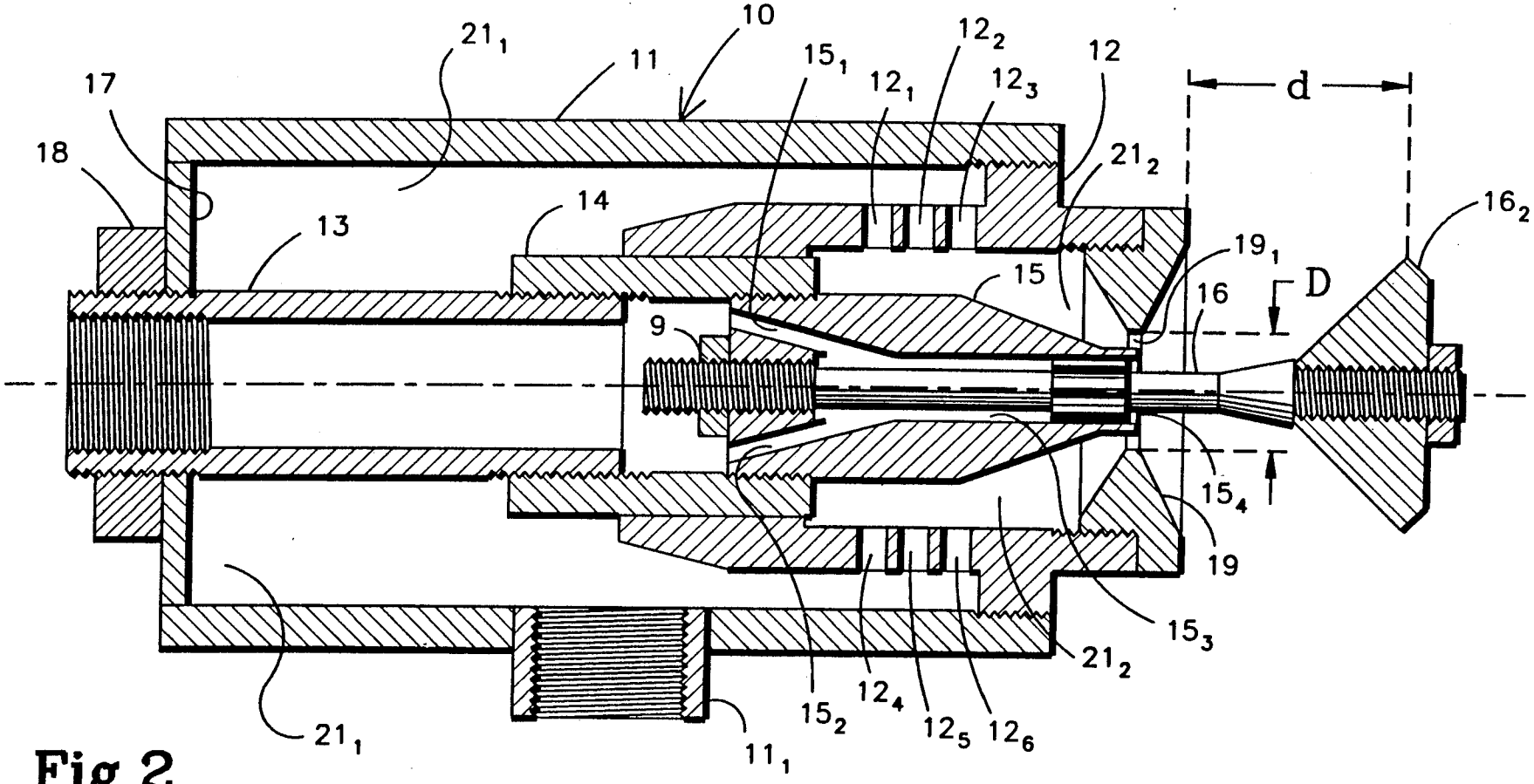
FIG. 2 depicts in cross-section, the assembled nozzle.

Nozzle 10, shown in FIG. 2 in assembled form, is thus constituted of an outer tubular body, or pipe 11 of relatively large internal diameter, and an inner assembly of tubular members 13, 14, 15 of relatively small external and internal diameters, adjoined together and concentrically axially aligned with the outer tubular body, or pipe 11. The assembly of small diameter tubular members is constituted of a connecting collar, or union 14 to the rearward end of which the small diameter pipe 13 is adjoined, suitably via threadable engagement therewith. The forward end of the union 14 is adjoined, suitably via threadable engagement therewith, to tubular shaft guide 15. The shaft assembly 16 is affixed within the shaft guide 15, suitably via threaded engagement of a terminal shaft end thereof to shaft guide 15, secured thereto via a lock nut 9, and coaxially aligned with the central opening therethrough to provide a continuous passageway between the tubular openings through pipe 13, union 14, openings $15_1$, $15_2$ within the shaft guide 15, and opening $15_3$ between the internal surface of the shaft guide 15 and external surface of the shaft $16_1$. The inner tubular assembly 13, 14, 15 is held in place, and maintained in coaxial alignment with and within the large diameter pipe 11 at its rearward side via an enclosing wall 17 to which the rearward externally threaded end of pipe 13 is threadably engaged, and locked rigidly in place via lock nut 18. It is held in place, and maintained in coaxial alignment with the large diameter pipe 11 at its forward side via the tubular member 12 of diameter intermediate the internal diameter of pipe 11 and the external diameter of the union 14 which is engaged within the rearward opening thereof when the nozzle is assembled. The ring partition, or member 19 provided with a central opening, is secured upon the forward, or upstream side of the tubular member 12, suitably via threadable engagement therewith.

The internal diameter of the pipe 11 is large relative to the external diameters of pipe 13 and union 14, and the external diameters of tubular member 12 and shaft guide 15, sufficiently so to provide chambers $21_1$, $21_2$ communicated one with the other via circumferential openings $12_1$, $12_2$, $12_3$, $12_4$, $12_5$, $12_6$, within the wall of tubular member 12. Accordingly, a fluid injected into the inlet $11_1$ of the pipe 11 will pass into the annular chamber $21_1$, and then via circumferential openings $12_1$ through $12_6$ into adjoining annular chamber $21_2$ to exit therefrom via the central opening $19_1$ located between the external surrounding surface of the ring partition 19 and external surrounding surface formed by the very forward end of the shaft guide 15.

The flow pattern of a fluid introduced via inlet $11_1$ into the nozzle 10 is best shown by reference to FIG. 3. Fluid emerging from the chamber $21_2$ via opening $19_1$ flows linearly in a direction coaxial with the axis of both the pipe 11 and assembly 13, 14, 15 to impact with the tapered side of the deflector $16_2$, or target, located at the forward end of the shaft assembly 16. A flow path concentric therewith is provided by the passageway formed between tubular openings through pipe 13, union 14, openings $15_1$, $15_2$, $15_3$ and a series of peripheral openings $16_3$ located in stabilizer $16_4$ of the shaft assembly. A fluid injected into the rearward end of pipe 13 will pass into, and then through the opening within union 14 into openings $15_1$, $15_2$, $15_3$, then into the peripheral openings $16_2$. Fluid emerging from the peripheral openings $16_2$ exits via opening $15_4$, located between the internal surface of the shaft guide 15 and external surface of the shaft $16_1$, and flows linearly in a direction coaxial with the axis of both pipe 11 and assembly 13, 14, 15 to impact with the tapered side of the deflector $16_2$. Thus, when a first fluid is injected via inlet $11_1$ into the outer adjoining chambers $21_1$, $21_2$ and a second fluid, different from the first, is injected into pipe 13, the two concentric streams flow substantially linearly outwardly from the openings $19_1$, $15_4$, respectively, to impact with the deflector $16_2$. On impact, the path of the two streams are redirected, gradually outwardly, in the same direction, and admixed one stream with the other.

In effect therefore, continuing the reference to FIG. 3, if as in a burner application, a fuel oil can be introduced into the nozzle 10 to flow via the continuous openings through pipe 13, union 14 and passageways $15_1$, $15_2$, $15_3$ and $16_3$ to exit via the annular opening $15_4$ in a direction substantially parallel with and encircling the axis of the shaft $16_1$ to impact with the deflector $16_2$. Oxygen, or an oxygen-containing gas such as air, or air enriched with oxygen, introduced via inlet $11_1$ will pass through chambers $21_1$, $21_2$ and exit via the annular opening $19_1$ in a direction substantially parallel with, encircling and surrounding the stream of oil exiting the annular opening $15_4$ to impact with the deflector $16_2$. On impact, the direction of both streams is forced outwardly, and merged one stream with the other as each follows the contour of the deflector $16_2$. Unlike conventional nozzles, the two fluids are maintained separate and apart within separate concentric compartments, and then brought together and admixed one stream within the other outside the nozzle at the deflector $16_2$. On combustion, the admixture of fuel oil and oxygen burns to supply heat as in a furnace operation, or drying operation, with minimum carbon deposition; with no carbon deposition inside the nozzle.

The deflector $16_2$, it will be observed, is of conic, or frusto conic shape, with the angled, or sloped surface faced inwardly toward the annular openings $15_4$, $19_1$. For best results, the angle of inclination alpha, of the sloped surface of the deflector $16_2$ from vertical, as depicted by reference to FIG. 3A, ranges between 25° and about 75°, preferably from about 35° to about 55°. A slight angle may also be provided in advance, or upstream of the deflector $16_2$ by a collar $16_5$, the angle of inclination beta, of the sloped surface of the collar $16_5$ ranging from about 70° to about 88°, preferably from about 80° to about 88°. The latter surface provides an initial gradual change in the direction of the fluid emerging from annular opening $15_4$ until, on impact with the deflector $16_2$ the path of the fluid is changed more abruptly for contact with the fluid stream emerging from opening $19_1$.

The deflector $16_2$ in all embodiments is extended outside the nozzle, and the distance of extension varied to control the spray fog pattern of the liquid. A spray fog pattern ranging from about 45° to about 120° is readily attainable. The deflector $16_2$ is thus adjustably retracted or advanced via rotation of shaft 16, which is threadably engaged to shaft guide 15, to different positions outside the ring partition member 19. The distance, d, of linear movement of the deflector $16_2$, measured from the forward face of ring partition member 19 to the very end of the sloped section of deflector $16_2$ as shown in FIG. 3A, ranges from about 0.5 times to about 5 times, preferably from about one to about 2 times, the gas orifice diameter, D, of ring partition member 19, or opening $19_1$. When used as a burner, the device can achieve very high turndown ratios, turndown ratios generally ranging from about 10:1 to about 30:1. Generally, from about 5 $ft^3$ to about 10 $ft^3$ of gas are required to atomize one gallon of liquid.

It is apparent that various modifications and changes can be made in the form of the apparatus without departing the spirit and scope of the invention. Changes in size, shape, or in the absolute and relative dimensions of most of the parts, or in the materials and in the construction of the apparatus, can be made without changing the nature of the structure as will be apparent to those skilled in this art.

Having described the invention, what is claimed is:

1. In apparatus for admixing a liquid hydrocarbon fuel and oxygen, air or other oxygen-containing gas, within which is included a body constituted of coaxially mounted tubular members, a small diameter pipe, shaft and shaft guide, adjoined one to the other, the shaft guide being located forward of the pipe, faced forwardly and containing the shaft the proximate end of which is mounted therein and the distal end of which carries a deflector of conic-shape extending outwardly of said assembly and positioned with its sloped side facing inwardly toward the forward terminal end of said small diameter pipe, the pipe providing a chamber into which a stream of the liquid hydrocarbon fuel can be injected via an inlet at the rearward end of said pipe and discharged via an outlet at the forward end of the shaft guide, a large diameter pipe within which said small diameter pipe, and assembled shaft and shaft guide, is axially mounted, the diameter of the pipe being sufficient to form an annular chamber between the inside wall surface of said large diameter pipe and the external wall surface of said small diameter pipe, an inlet and outlet communicating with said annular chamber to provide a passageway, separate from that which carries the hydrocarbon liquid fuel, for carrying the oxygen, air or other oxygen-containing gas the improvement wherein the outlets of both the small diameter and large diameter pipes, respectively, form concentric annuli, are in close proximity, faced toward, and in a straight line with the inwardly facing sloping surface of the deflector to provide parallel flow paths for concentric tubular columns of the liquid hydrocarbon fuel, and the oxygen, or air or other oxygen-containing gas, ejected from the annular outlets of each of the pipes, respectively, so that both streams impact with the sloping surface near the apex of the cone of the deflector located at a distance outwardly of said assembly ranging from about 0.5 to about 5 times the diameter of the opening through which the oxygen, or air or other oxygen-containing gas, is ejected, and each stream forced outwardly from the apex of the cone to admix one stream with the other to form a combustible mixture which, on ignition, burns ex situ of the burner body.

2. The apparatus of claim 1 wherein the small diameter pipe, and shaft guide within which the shaft carrying the deflector is mounted, are joined one to the other via a union.

3. The apparatus of claim 1 wherein the pipe, union and shaft guide are threadably joined one member with the other, and the shaft of the deflector is axially aligned with and threadably joined to the shaft guide.

4. The apparatus of claim 1 wherein the rearward end of the large diameter pipe is enclosed by an end wall provided with a central internally threaded opening, the two ends of the small diameter pipe is externally threaded, the rearward end of the shaft guide is externally threaded and provided with an internally threaded opening, and the small diameter pipe and the shaft guide are joined together by a union both ends of which are internally threaded and threadably engaged with the forward end of the small diameter pipe and rearward end of the shaft guide, respectively, to form the assembly, the rearward end of the shaft is externally threaded and threadably engaged with the internally threaded central shaft guide opening, and the rearward end of the small diameter pipe is threadably engaged with the internal threads of the rearward end wall for support of the structure.

5. The apparatus of claim 4 wherein the structural combination further includes a tubular member of intermediate diameter located at the forward end of the tubular body for supporting the forward end of the small diameter pipe-shaft guide/deflector assembly.

6. The apparatus of claim 5 wherein the side wall of the tubular member of intermediate diameter is perforated to provide openings to pass the stream of gas to a continuous outer chamber formed between the inside surface thereof and the external surface of the shaft guide, and an enclosing forward end wall is located upon the forward end thereof.

7. The apparatus of claim 6 wherein the forward end of the tubular member of intermediate diameter is threaded, and threadably engaged with a forward end cover provided with a central opening with which the outlets of the large diameter tube and small diameter tube, respectively, are communicated.

8. A nozzle for admixing a liquid hydrocarbon fuel with oxygen, air or other oxygen-containing gas, and burning the mixture to supply heat which comprises an assembly of tubular members constituted of a pipe of relatively small diameter and shaft guide, adjoined one to the other, the shaft guide being faced forwardly and containing a shaft the proximate end of which is mounted therein and the distal end of which carries a deflector of conic-shape extending outwardly of said assembly and positioned with its sloped side facing inwardly toward said assembly, the assembly providing a chamber into which a stream of the liquid hydrocarbon fuel can be injected via the open rearward end of said pipe and discharged through the shaft guide which provides a forward annular outlet, a large diameter pipe, with inlet, within which said assembly of tubular members is concentrically mounted, the diameter of the pipe being sufficient to form an annular chamber between the inside wall surface of said large diameter pipe and the external wall surfaces of said assembly, the annual chamber providing a passageway isolated from said chamber carrying said liquid hydrocarbon fuel for carrying the oxygen, air or other oxygen-containing gas, a pipe of intermediate diameter provided with side wall perforations located at the forward end of the body between the inside wall surface of the large diameter pipe and external wall surface of the shaft guide of the assembly, forming an extension of said annular chamber for carrying said liquid hydrocarbon fuel, a rearward end wall, provided with a central opening through which the small diameter pipe of said assembly is extended, enclosing the rearward opening of the large diameter pipe, a forward end wall provided with a central opening enclosing the forward end of said intermediate diameter pipe, said central opening leaving an annular outlet for the discharge of oxygen, air or other oxygen-containing gas from the annular passageway, and for the discharge of liquid hydrocarbon fuel from the forward end of the shaft guide via said forward outlet in the small diameter pipe; said deflector extending outwardly of said assembly of tubular members to a distance ranging from about 0.5 to about 5 times the diameter of said outlet in the intermediate diameter pipe through which oxygen, air or other oxygen-containing gas is ejected, whereby, concentric tubular streams of the liquid hydrocarbon fuel, and the oxygen, or air or other oxygen-containing gas, ejected from the annular outlet of each will impact with the sloped face of the conic-shape deflector and forced outwardly to admix one stream with the other to form a combustible mixture which, on ignition, will burn ex situ of the nozzle.

9. The apparatus of claim 8 wherein the assembly of tubular members constituted of a small diameter pipe and shaft guide with deflector, are joined together via a union and these members are threadably engaged one member with the other.

10. The apparatus of claim 8 wherein the assembly of tubular members constituted of a small diameter pipe and shaft guide with deflector, are joined together via a union and these members are threadably engaged one member with the other, the small diameter pipe is threadably engaged with the rearward wall enclosing the rearward opening of the large diameter pipe, and the forward end wall is threadably engaged with the forward end of the intermediate diameter pipe.

11. The apparatus of claim 8 wherein the angle of inclination of the sloped surface of the deflector, from vertical, ranges from about 25° to about 75°.

12. The apparatus of claim 11 wherein the angle ranges from about 35° to about 55°.

13. The apparatus of claim 8 wherein the distance of the deflector outwardly of said assembly ranges from about one to about 2 times the diameter of the annular opening through which the gas is ejected.

14. The apparatus of claim 8 wherein the shaft which carries the deflector is reciprocally mounted within said small diameter pipe and shaft guide.

* * * * *